US005119952A

United States Patent [19]

Warriner, Jr.

[11] Patent Number: 5,119,952

[45] Date of Patent: Jun. 9, 1992

[54] POSTCARD-TYPE PACKAGE FOR FLOWABLE SUBSTANCES

[76] Inventor: Watson C. Warriner, Jr., 97 N. Main St., Cranbury, N.J. 08512

[21] Appl. No.: 575,220

[22] Filed: Aug. 30, 1990

[51] Int. Cl.[5] ..... B65D 73/00

[52] U.S. Cl. ..... 206/462; 206/471; 206/588; 229/71; 229/92.8

[58] Field of Search ..... 206/461, 462, 463, 466, 206/467, 471, 472, 475, 486, 488, 495, 587, 588, 581; 229/71, 92, 92.8

[56] References Cited

U.S. PATENT DOCUMENTS

| | | | |
|---|---|---|---|
| 1,011,697 | 12/1911 | Witkowski | 206/462 |
| 1,180,618 | 4/1916 | Stirn | 206/462 X |
| 1,700,065 | 1/1929 | March | 206/466 |
| 1,714,774 | 5/1929 | Goldsmith | 206/475 |
| 1,943,074 | 1/1934 | Heyman | 229/92 X |
| 2,646,876 | 7/1953 | Sparks | 206/46 |
| 2,833,402 | 5/1958 | Lefebvre | 206/466 |
| 2,878,061 | 3/1959 | Saeks | 206/462 X |
| 2,931,494 | 4/1960 | Pfohl | 206/462 |
| 3,307,281 | 3/1967 | Mateo | 229/92.8 X |
| 3,587,848 | 6/1971 | Froehlig | 206/462 |
| 3,621,994 | 11/1971 | Brown | 206/65 |
| 4,240,547 | 12/1980 | Taylor | 206/204 |
| 4,559,727 | 12/1985 | Lewyt | 229/92.8 X |
| 4,679,688 | 7/1987 | Soderholm et al. | 206/204 |
| 4,777,964 | 10/1988 | Briggs et al. | 128/760 |
| 4,840,275 | 6/1989 | Faiola et al. | 206/462 X |
| 4,865,247 | 9/1989 | Grabner | 229/92.1 |
| 4,870,764 | 10/1989 | Boone | 229/92.8 X |
| 4,884,684 | 12/1989 | Bernardin et al. | 206/204 |
| 4,951,404 | 8/1990 | Lithwick | 206/462 X |

FOREIGN PATENT DOCUMENTS 684139 4/1964 Canada .

*Primary Examiner*—Paul T. Sewell
*Assistant Examiner*—Jacob K. Ackun, Jr.
*Attorney, Agent, or Firm*—Morgan & Finnegan

[57] ABSTRACT

A postcard-type package comprising a relatively stiff substantially flat sheeet having one or more foldlines that form sections, one section having a slotted opening. A rigid cradle is inserted into the slotted opening and secured to a section by a retaining flange. The rigid cradle has a shape that will contain a sample container. The container containing a flowable substance is inserted into the cradle and the sections are folded along the foldlines as to encapture the container between the cradle and a section.

33 Claims, 5 Drawing Sheets

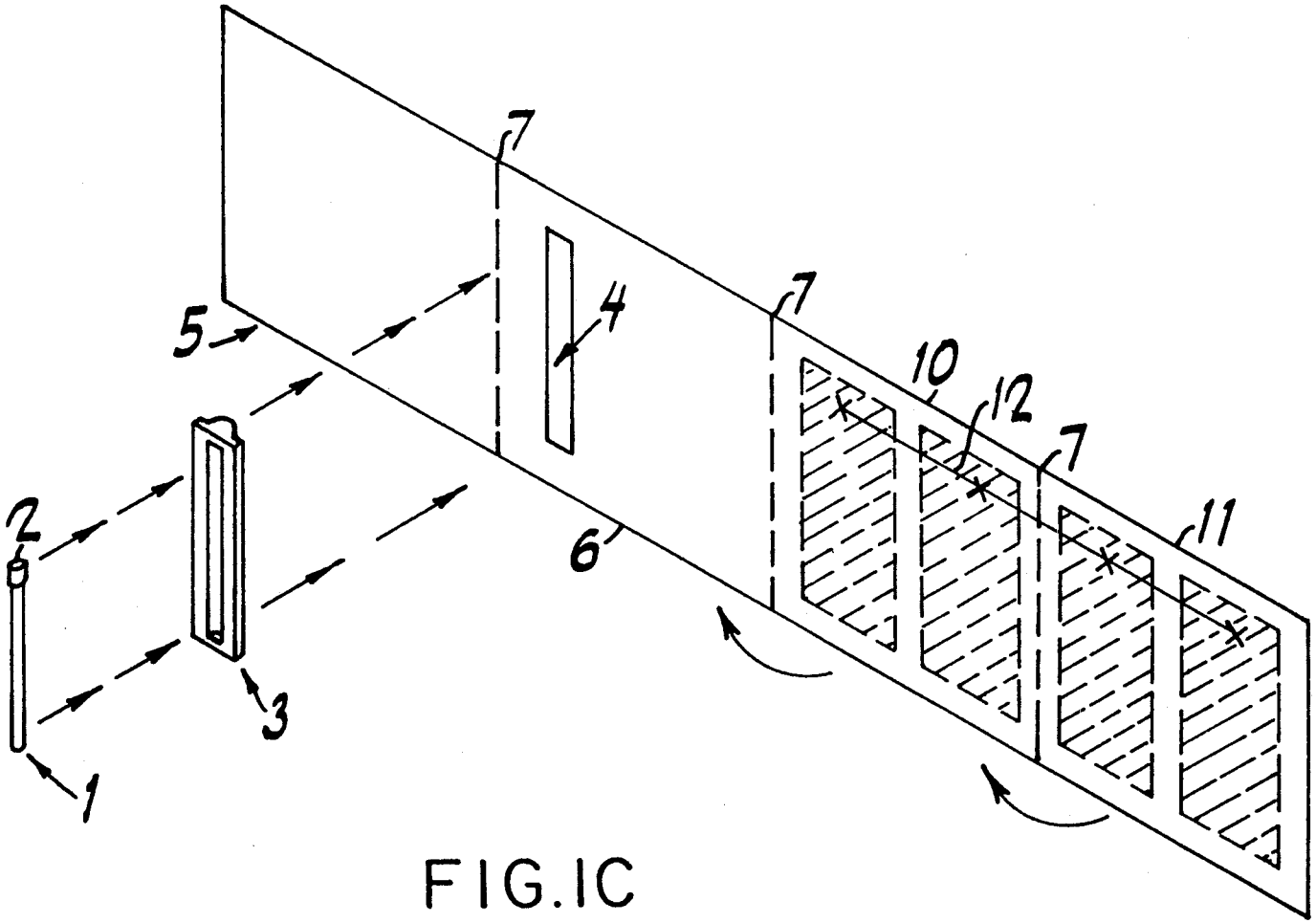
FIG.IC

POSTCARD-TYPE PACKAGE FOR FLOWABLE SUBSTANCES

BACKGROUND AND OBJECTS OF THE INVENTION

1. Field of the Invention

The present invention relates to a postcard-type package for flowable substances and the like and, more specifically, to a new configuration for a mailable package which contains a container with a quantity of flowable product normally called for in sampling.

2. Description of the Prior Art

Various attempts have heretofore been made to provide a mailable package for fragile items. The Sparks U.S. Pat. No. 2,646,876 (hereinafter the 876 patent) discloses a mailable display package to hold an article for shipment which uses a thick boxboard to form the structure and employs a series of flaps to seal the package.

A drawback of the 876 patent is a requirement for a thick boxboard that increases the weight of the shipping container, increases the size of the total package and increases the material costs. A further drawback of the boxboard is an increased difficulty in producing the boxboard with the required cut-outs and creases which results in increased production costs. A still further drawback of the 876 patent is the increased production costs involved with producing the large number of flaps.

The Taylor U.S. Pat. No. 4,240,547 (hereinafter the 547 patent) discloses a compact, reusable specimen mailer to safely ship fragile specimens. It uses a polystyrene plastic foam to form the structure and employs an absorbent material around the specimen containers.

The Briggs U.S. Pat. No. 4,777,964 (hereinafter the 964 patent) discloses a blood sampling kit and a method of use which uses a base member and a backing to serve as a floor portion for blood vials. It further contains an alcohol swab, a finger-pricking element and clay. In addition, the 964 patent employs a separate masked envelope, FIG. 2, to send the samples safely via the postal service.

3. Objects of the Invention

It is therefore an object of this invention to provide a new and improved postcard-type package for shipping sample containers via the postal service.

Another object of this invention is to provide a new and improved postcard-type package for shipping sample containers which overcomes the aforesaid drawbacks of the 876 patent, i.e., requirement for a boxboard.

Another object of this invention is to provide a new and improved postcard-type package for shipping sample containers which is easy and inexpensive to produce and assemble.

Another object of this invention is to provide a new and improved postcard-type package for shipping sample containers via the postal service which involves minimum shipping costs due to the size and weight of the shipping package.

Another object of this invention is to provide a new and improved postcard-type package for shipping sample containers via the postal service which safely retains a fragile container while allowing the receiver of the postcard-type package to open the package and easily remove the sample container from the cradle.

Another object of this invention is to provide a new and improved postcard-type package for shipping sample containers involving a cradle comprising one or more clasps protruding from the surface of the cradle for retaining the container.

A further object of this invention is to provide a new and improved postcard-type package for shipping sample containers which visibly displays the sample container when the package is sealed in order to maximize the sample container's visibility at the receiving point.

A still further object of this invention is to provide a new and improved postcard-type package which contains a rip-off business postcard in order to allow a sender to receive a reply.

Objects and advantages of the invention are set forth in part herein and in part will be obvious therefrom, or may be learned by practice with the invention, the same being realized and attained by means of the instrumentalities and combinations pointed out in the appended claims.

The invention consists of the novel parts, constructions, arrangements, combinations, steps and improvements herein shown and described.

SUMMARY OF THE INVENTION

The present invention is directed to a new and improved postcard-type package for flowable substances which may be used for shipping sample containers via the postal service employing a low cost sheet, such as a single-ply cardboard, and a cradle which may be composed of a plastic type material. The cardboard sheet is inexpensively produced requiring only one or more foldlines and a slotted opening.

In a preferred embodiment, the postcard-type package comprises a relatively stiff flat sheet having a creased centerline forming a first and second section, a slotted opening cut in the second section and a cradle. The cradle comprises a rigid material shaped in such way that the cradle retains a container. The cradle is inserted into the slotted opening and secured by a flange to the second section. The container containing a flowable substance is inserted into the cradle. The container is a sample vial with a stopper. A sealing means, preferably comprising tape or glue, is employed to hold the folded first and second sections securely together.

A preferred cradle is composed of a non-opaque material that allows the container to be seen through the cradle. Further, the container includes a label. A preferred container contains a sample quantity of a fragrance for advertising purposes.

A preferred cradle has a means for retaining the container. The retaining means is designed to maintain the container in the cradle whereby the container's movement is sufficiently restricted in order to substantially reduce the possibility that the container will be damaged during shipping of the postcard-type package. At the same time, the retaining means is designed to allow the receiver to easily remove the container from cradle. An example of the ease of removing the container from the cradle entails the receiver opening the postcard-type package and applying a removal force in order to separate the container from the cradle. Such removal force may consist of using a fingernail to pick out the container from the cradle. An example of the retaining means consist of one or more molded clasps that are an integral part of the cradle protruding out from the inside. Alternatively, one or more clasps are separate pieces that are fastened directly to the inside surface of the cradle.

In a preferred embodiment, the first section is a business reply card to enable the receiver to simply, easily and at no expense, communicate directly with the sender.

Preferably, the sections are folded along the crease to enable direct contact with each other, thus, forming a sealed package to enable the container to be safely shipped without further restraining devices.

As used herein, the term "foldlines" are intended to encompass a single straight line extending completely across the relatively stiff flat sheet formed by a scored continuous line.

It will be apparent from the foregoing general description that the objects of the invention specifically enumerated herein are accomplished by the present invention.

Thus, it has been found that a postcard-type package can be constructed more economically utilizing thin gauge materials than those utilized to construct prior packages containing sample containers. In addition, it has been found that production and assembly of a package can be substantially reduced at the same time the likelihood of damage to the container can be eliminated by utilizing the invention. Moreover, it has been found that the invention increases the advertising visibility of the product by displaying the container.

It will be understood that the foregoing general description and the following detailed description are exemplary and explanatory of the invention but are not restrictive thereof.

The accompanying drawings, referred to herein and constituting a part hereof, illustrate preferred embodiments of the present invention, and together with the description serve to explain the invention.

BRIEF DESCRIPTION OF THE DRAWINGS

FIGS. 1A, 1B and 1C are a perspective view of alternative embodiments of a postcard-type package in its opened condition, the view showing the placement of the container into the cradle and of the cradle into the slotted-opening of the relatively stiff substantially flat sheet containing foldlines.

FIG. 3A is a top perspective view. FIG. 3B is a fragmentary view illustrating the clasps. FIG. 3C is a side perspective view.

DESCRIPTION OF THE PREFERRED EMBODIMENTS

Figure 1A:
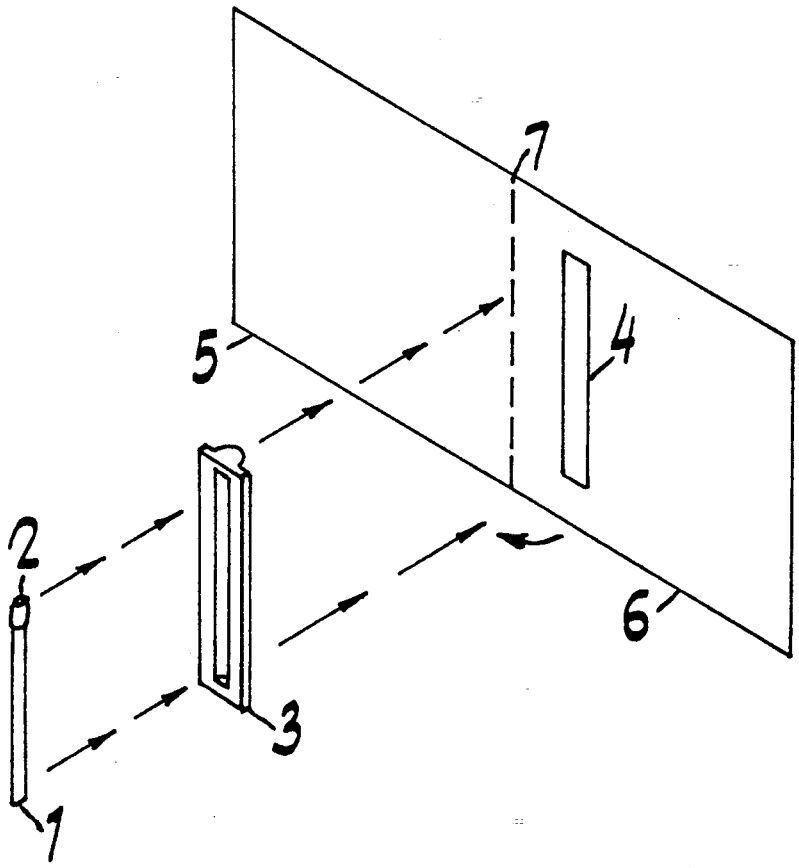

Referring now more particularly to FIGS. 1A, 2A, 2B and 2C of the accompanying drawings, there is illustrated a postcard-type package constructed in accordance with the preferred embodiment of the present invention.

As here embodied, the invention includes a relatively stiff substantially flat sheet divided by a creased foldline 7 advantageously into two equal sized sections, 5 and 6. Section 6 is provided with a slotted opening 4 where a cradle 3 is in direct contact with section 6 by flange 13. Container 1 has a removable stopper 2 and is mounted directly into cradle 3.

Preferably, the relatively stiff substantially flat sheet is made up of a single-ply cardboard, the cradle 3 is made up of polystyrene or polyester or a copolymer thereof, and the container 1 is made of glass or plastic which may depend upon the nature of the contents and the material costs.

Figure 2A:
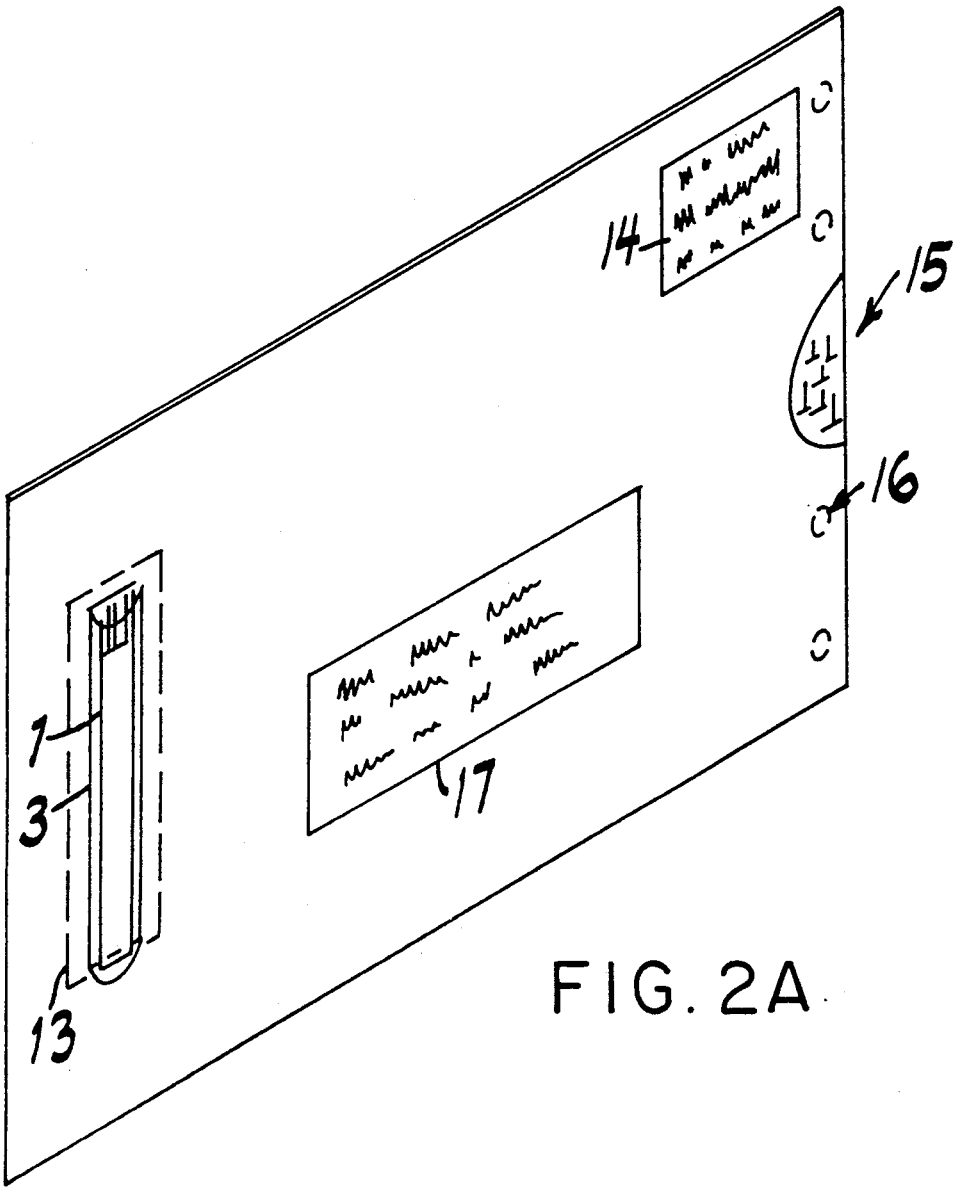
FIG. 2A is a front angled perspective view of the postcard-type package shown in FIG. 1, this view illustrating the package in its closed condition for shipping and showing the visibility of the container.

It will be seen from the foregoing that the structure of FIGS. 1A and 2A forms an enclosed chamber between section 5 and cradle 3, in which container 1 is held. This is accomplished by folding sections 5 and 6 along the creased foldline 7 in the direction shown in FIG. 1A until sections 5 and 6 contact each other.

Figure 2B:
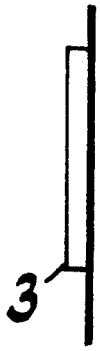
FIGS. 2B and 2C are side perspective views of the postcard-type package shown in FIG. 2A.
Figure 2C:
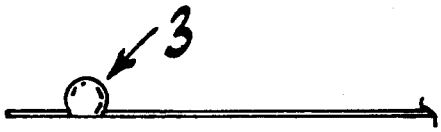

As seen in FIG. 2A, folded sections 5 and 6 form a package and are secured by seal 15 and/or adhesive 16. In this sealed form, container 1 is visible but enclosed within cradle 3. In addition, as shown in FIG. 2A, section 5 has space for mailing label 17 and postage 14. FIGS. 2B and 2C further show side views of the folded postcard-type package.

Referring more particularly to the preferred embodiment, FIG. 1A, section 5 contains a printed communication in the form of a business reply card. After receiving the folded postcard-type package in the form shown in FIG. 2, the postcard-type package can be unfolded and section 5 can be separated from section 6 at foldline 7 and section 5 can be returned to the sender.

Figure 1B:
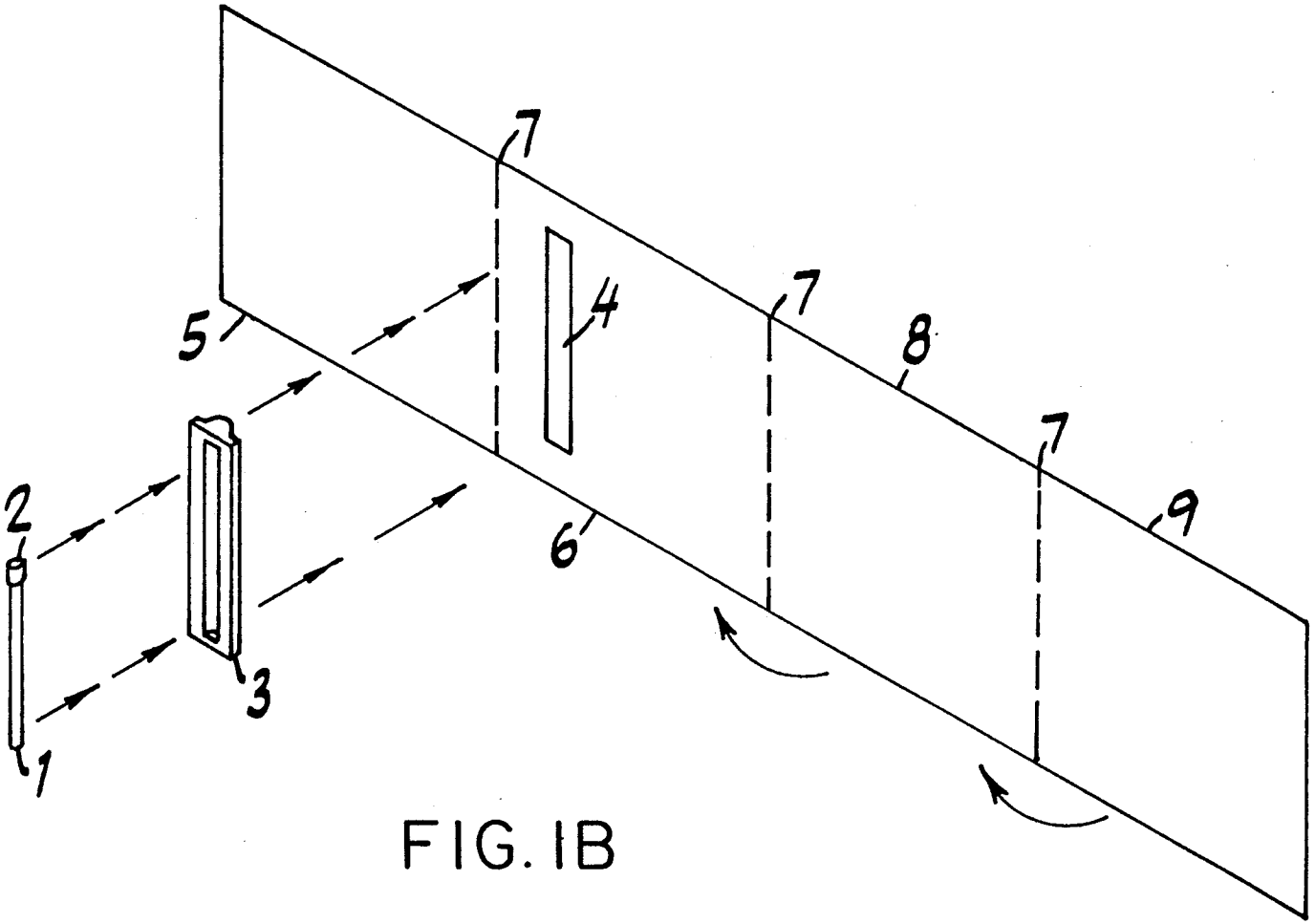

FIG. 1B illustrates a further advantageous arrangement for a postcard-type package containing sections 5, 8 and 9 that are one or more business reply cards which can be separated along foldline 7.

FIG. 1C illustrates a still further advantageous arrangement for a postcard-type package containing sections 5, 10 and 11 that are one or more business reply cards and/or packettes 12 containing a flowable substance which can be separated along foldline 7. Packettes 12 are shaped to fit securely in the postcard-type package and are preferably made up of burst-proof packettes.

Figure 3B:
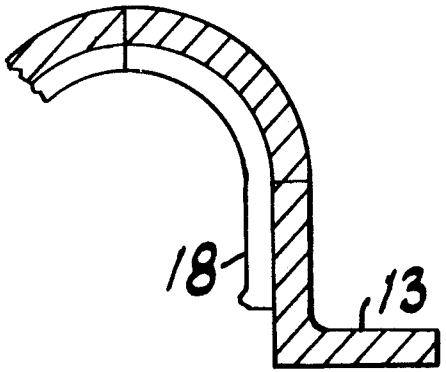
FIGS. 3A, 3B and 3C are perspective views of the cradle.
Figure 3A:
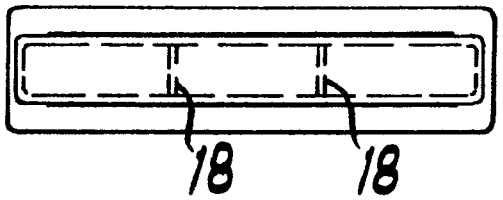
Figure 3C:
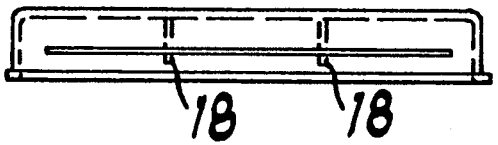

Perspective views of cradle 3 are shown in FIGS. 3A, 3B and 3C. In a preferred embodiment, cradle 3 is provided with one or more clasps 18 protruding from the surface of cradle 3 for retaining container 1. As illustrated in FIG. 3B, clasp 18 is located around the inside circumference of the cradle. As can be seen in FIG. 3C, clasp 18 can consist of a separate curvilinear piece attached to the inner surface of the cradle or can be molded clasps that are an integral part of the cradle protruding out from the inner surface of cradle 3.

To the extent not already indicated, it also will be understood by those of ordinary skill in the art that any one of the various specific embodiments herein described and illustrated ma be further modified to incorporate features shown in other of the specific embodiments, as desired.

The invention in its broader aspects therefore is not limited to the specific embodiments herein shown and described but departures may be made therefrom within the scope of the accompanying claims, without departing from the principles of the invention and without sacrificing its chief advantages.

What is claimed is:

1. A postcard-type package for shipping a fragile container holding a flowable substance, said package being suitable for mailing by itself, said package consisting essentially of:

(a) a relatively stiff substantially flat sheet having a front and a back face, said sheet further having a foldline forming a first section and a second section, said second section having a slotted opening;

(b) a rigid cradle comprising:

(i) a chamber having a length and width sufficient to enable said container to fit within said chamber and having a shape substantially corresponding to the shape of said container;

(ii) an open base for inserting said container into said chamber;

(iii) a flange integral to said chamber and extending outwardly from each side of said open base, said flange mounted on said front face of said slotted second section in a position allowing said cradle to protrude through said slotted opening, and (iv) one or more clasps protruding out from said inner surface and extending across the entire inner surface of said chamber in the widthwise direction, said clasps being present in a number sufficient to restrict said container's movement during shipping but allow for said container's removal after shipping, said clasps being the sole means required for retaining said container and preventing damage to said container during shipping;

(c) a means for securing said first section to said second section of said sheet after folding said sheet about said foldline so that the front face of said first section contacts said front face of said second section.

2. A postcard-type package as recited in claim 1, wherein said securing means is a fastener selected from the group consisting of wafer seal, adhesive substance, staples, and tape.

3. A postcard-type package as recited in claim 1, further comprising a mailing label on said back side.

4. A postcard-type package as recited in claim 1, wherein said first section contains a printed communication.

5. The postcard-type package as recited in claim 1, further consisting essentially of the fragile container and a removable stopper for said container.

6. A postcard-type package as recited in claim 5, wherein said container has a label that is visible through said cradle.

7. A postcard-type package as recited in claim 5, wherein said container is composed of glass.

8. A postcard-type package as recited in claim 5, wherein said container contains a fragrance.

9. The postcard-type package as recited in claim 1, wherein said sheet has one or more additional foldlines forming one or middle sections in addition to the first and second sections, said one or more middle sections folded along said foldlines in a direction toward the front face of said sheet.

10. The postcard-type package as recited in claim 1, wherein at least two clasps are present and wherein said chamber said flanges, and said clasps are composed of a rigid plastic material.

11. The postcard-type package as recited in claim 1, wherein said rigid plastic material is non-opaque.

12. The postcard-type package as recited in claim 11, wherein said plastic material is polystyrene or a polyester copolymer.

13. A postcard-type package as recited in claim 1, wherein the clasps extend continuously around substantially the entire inner surface and span across substantially the entire inner surface of said chamber.

14. A postcard-type package for shipping a fragile container holding a flowable substance, said package being suitable for mailing by itself, said package consisting essentially of:

(a) a relatively stiff substantially flat sheet having a front and a back face, said sheet further having a plurality of foldlines so that said sheet is divided along foldlines into a left and right end section and one or more middle sections, said middle section adjacent to said left end section having a slotted opening;

(b) a rigid cradle comprising (i) a chamber having a length and width sufficient to enable said container to fit within said chamber and having a shape substantially corresponding to the shape of said container;

(ii) an open base for inserting said container into said chamber, (iii) a flange integral to said chamber and extending outwardly from each side of said open base, said flange mounted on said front face of said slotted middle section in a position allowing said cradle to protrude through said slotted opening, and (iv) one or more clasps protruding out from said inner surface and extending across the entire inner surface of said chamber in the widthwise direction, said clasps being present in a number sufficient to restrict said container's movement during shipping but allow for said container's removal after shipping, said clasps being the sole means required for retaining said container and preventing damage to said container during shipping; and (c) a means for securing said slotted middle section to said end sections and any middle sections other than the slotted middle section, said sections being folded along said foldlines in a direction toward the front face of said sheet.

15. A postcard-type package as recited in claim 14, wherein said securing means is a fastener selected from the group consisting of wafer seal, adhesive substance, staples, and tape.

16. A postcard-type package as recited in claim 14, further comprising a mailing label on said back slide.

17. A postcard-type package as recited in claim 14, wherein one or more of said sections contain a printed communication.

18. A postcard-type package as recited in claim 14, wherein one or more of said sections include packettes containing a flowable substance.

19. A postcard-type package as recited in claim 14, further consisting essentially of the fragile container and a removable stopper for said container.

20. A postcard-type package as recited in claim 19, wherein said container has a label that is visible through said cradle.

21. A postcard-type package as recited in claim 19, wherein said container is composed of glass.

22. A postcard-type package as recited in claim 19, wherein said container contains a fragrance.

23. The postcard-type package as recited in claim 14, wherein at least two clasps are present and wherein said chamber, said flanges, and said clasps are composed of a rigid plastic material.

24. The postcard-type package as recited in claim 14, wherein said rigid plastic material in non-opaque.

25. The postcard-type package as recited in claim 24, wherein said plastic material is polystyrene or a polyester copolymer.

26. A postcard-type package as recited in claim 14, wherein the clasps extend continuously around substantially the entire inner surface and span across substantially the entire inner surface of said chamber.

27. A rigid cradle for retaining a fragile container during shipping, said cradle comprising:

(a) a chamber having a length and width sufficient to enable said container to fit within said chamber and having a shape substantially corresponding to the shape of said container;

(b) an open base for inserting said container into said chamber, (c) a flange integral to said chamber and extending outwardly from each side of said open base, and (d) one or more clasps protruding out from said inner surface and extending continuously around substantially the entire inner surface and spanning across substantially the entire inner surface of said chamber in a widthwise direction, said clasps being present in a number sufficient to restrict said container's movement during shipping but allow for said container's removal after shipping, said clasps being the sole means required for retaining said container and preventing damage to said container during shipping.

28. The cradle as recited in claim 27, wherein at least two clasps are present and wherein said chamber, said flange, and said clasps are composed of a rigid plastic material.

29. The cradle as recited in claim 28, wherein said plastic material is non-opaque.

30. The cradle as recited in claim 29, wherein said plastic material is polystyrene or a polyester copolymer.

31. The cradle as recited in claim 27, wherein said chamber, said flanges and said clasps or clasps are molded in one piece from a rigid plastic.

32. The cradle as recited in claim 27, wherein said clasp or clasps have pinch points located on each end of said clasp or clasps.

33. The cradle as recited in claim 28, wherein said chamber, said flange, and said clasps are molded in one piece from polystyrene and wherein said clasps have pinch points located on each end of said clasps.

* * * * *